United States Patent [19]

Margulies

[11] 4,262,816

[45] Apr. 21, 1981

[54] CONTAINER AND DISPENSING PLATE FOR A ROLL OF PREMOISTENED TOWELETTES

[75] Inventor: Herman Margulies, Westfield, N.J.

[73] Assignee: Sterling Drug Inc., New York, N.Y.

[21] Appl. No.: 38,780

[22] Filed: May 14, 1979

Related U.S. Application Data

[63] Continuation-in-part of Ser. No. 950,616, Oct. 12, 1978.

[51] Int. Cl.[3] ..... A47K 10/38

[52] U.S. Cl. ..... 221/46; 206/409; 221/63; 225/106

[58] Field of Search ..... 221/44–63; 225/106, 52; 206/205, 210, 389, 395, 396, 397, 409; 229/62; 220/404; 242/55.54

[56] References Cited

U.S. PATENT DOCUMENTS

| | | | |
|---|---|---|---|
| 2,981,990 | 5/1961 | Balderree | 229/62 UX |
| 3,749,296 | 7/1973 | Harrison | 225/106 |
| 3,843,017 | 10/1974 | Harrison | 221/63 |
| 3,868,052 | 2/1975 | Rockefeller | 225/106 |
| 3,908,822 | 9/1975 | Giberstein | 206/278 |
| 3,973,695 | 8/1976 | Ames | 221/63 |
| 3,979,019 | 9/1976 | Bliss | 221/48 |
| 3,986,479 | 10/1976 | Bonk | 221/47 X |
| 3,994,417 | 11/1976 | Boedecker | 221/63 X |
| 4,017,002 | 4/1977 | Doyle et al. | 221/63 |

*Primary Examiner*—F. J. Bartuska

*Attorney, Agent, or Firm*—Wenderoth, Lind & Ponack

[57] ABSTRACT

A package and dispensing device for a continuous roll of premoistened towelettes includes an outer container that holds therein the roll of premoistened towelettes, the roll being surrounded by a bag which prevents the roll from drying out. The towelettes are pulled away from the roll through a hole in a sealing and dispensing plate and are pulled out of the top of the container. The plate may be planar or conical.

21 Claims, 11 Drawing Figures

CONTAINER AND DISPENSING PLATE FOR A ROLL OF PREMOISTENED TOWELETTES

This is a continuation-in-part of application Ser. No. 950,616, filed Oct. 12, 1978.

BACKGROUND OF THE INVENTION

The present invention relates to a package and a dispensing plate primarily for use in dispensing and separating premoistened towels or smaller towelettes from a continuous web of toweling material.

Premoistened sheets or towelettes are increasingly popular among consumers because they are convenient and easily provide a "damp cloth" even when water is not readily available. For the most part, these sheets are either individually wrapped or come as part of a continuous web which is rolled and perforated so that it can be separated into a plurality of individual sheets. This invention relates to the dispensing of the sheets or towelettes packaged as a rolled, continuous web.

Presently, rolls of towelettes are delivered to the consumer in a plastic container with a separable top removably fitted over the container. The top has a specifically designed outlet for withdrawing the towelettes on the roll therethrough and for subsequently separating the individual towelettes from the roll. Novelty among different containers and tops lies primarily in the construction of the opening through which the towelettes are required to pass as they are removed from the roll. The opening must be large enough to permit the towelettes to fit therethrough and, at the same time, must be small enough to exert enough frictional pull on the towelettes to cause them to separate along the perforated dividing lines.

Several examples of previously patented containers include: U.S. Pat. No. 4,017,002 to Doyle et al., wherein the opening is a combination of cross-slits; U.S. Pat. No. 3,994,417 to Boedecker, wherein the towelette is withdrawn through a plate which has a single circular opening therethrough; U.S. Pat. No. 3,868,052 to Rockefeller, wherein an opening is provided which has protrusions directed toward the central portion of the opening; U.S. Pat. No. 3,843,017 to Harrison, wherein the opening has a flap thereacross which slightly engages the continuous web as it is withdrawn through the opening; and U.S. Pat. No. 3,973,695 to Ames, wherein the opening is an elongated opening through which the continuous web is withdrawn.

While all of these prior art towelette dispensers seem to function well and achieve their goal of separating the individual towelettes from the continuous perforated web, there are drawbacks. The major drawback and area for improvement is the total packaging concept which currently requires expensive materials for forming the package, much hand labor, and ultimately, disposal of the spent container. The dispenser/containers now available are almost entirely formed from extruded and molded plastics, have a top with the specific type of outlet therethrough positioned on top of the container with the web thereinside, and require that the web be initially fed through the opening so that it is ready to be used. Also, the dispensing opening must be conveniently sealed in some way to prevent the premoistened towelettes from drying out before reaching the consumer. Further, since the containers are of rigid plastic, disposal becomes a problem, since the containers are bulky even when empty and since they create polluting fumes when they are burned.

SUMMARY OF THE INVENTION

It is, therefore, an object of the present invention to provide a new and improved package for storing and dispensing a continuous web of premoistened sheets or towelettes.

Furthermore, it is also an object of the invention to provide a package which is lightweight and easily and economically formable, and is readily and conveniently disposable. Also, the package can be formed and prepared for marketing with a minimum of manual labor.

These objects are achieved according to the present invention by providing a moisture-proof container which contains a premoistened roll of towelettes thereinside within a moisture-proof bag. A special dispensing plate with a slit and a hole therein rests on top of the roll of towelettes, and the end of the web of towelettes projects through the slit in the plate. The towelettes slide through the slit into the hole which is large enough to allow the towelettes to be withdrawn easily therethrough, but which is small enough to ensure that friction is exerted on the web to cause the individual towelettes to separate from each other.

BRIEF DESCRIPTION OF THE DRAWINGS

Further objects and a better understanding of the novel features of the present invention will become apparent from the following detailed description taken with the accompanying drawings, wherein.

DETAILED DESCRIPTION OF THE INVENTION

Figure 1:
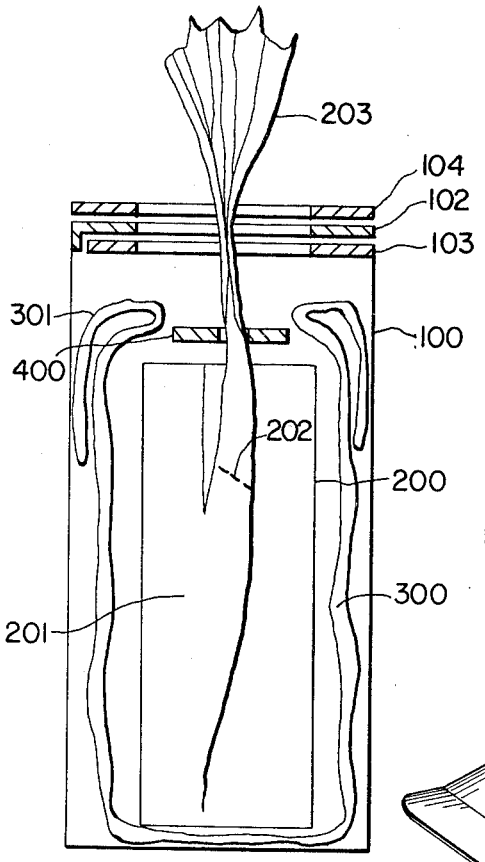
FIG. 1 is a schematic sectional view of one embodiment of a container according to this invention.

FIG. 1 shows the general configuration of a dispensing package of the present invention. An outer container 100 holds therein a roll 200 of premoistened towelettes. The roll 200 within the container is also surrounded by a bag 300 which helps to prevent the roll from drying out. The top 301 of the bag is opened and folded back inside the outer container 100. The towelettes are pulled away from the roll 200 and out of the top 301 of the bag through a dispensing plate 400.

The outer container 100 may be of any construction which will suitably contain the roll 200. For ease in assembly and disposal, a simple paper box which is treated to be moisture-resistant (for example, the paper may be plastic-coated) is adequate. This will provide a container which is lightweight yet sturdy, and which will increase the ease of handling and stacking the rolls. It is, of course, recognized that other containers with other shapes and constructions may also serve adequately.

Figure 2:
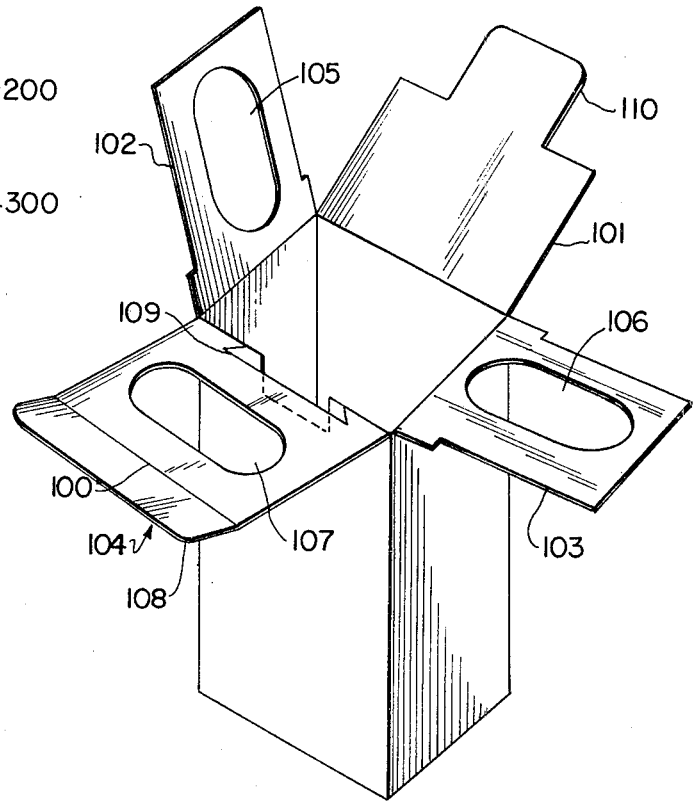
FIG. 2 is a perspective view of the container of this invention.

The container 100 has, as shown in FIG. 2, four sides, a bottom, and a hinged top 101. The top, when opened, reveals three flaps 102, 103, 104 with openings 105, 106, 107 respectively therethrough. When these three flaps are folded across the top of the box, the openings are aligned, and the end towelette of the roll 200 can be pulled therethrough. The top side flaps 102, 103 are designed to be folded one on top of the other, and the third flap 104 is folded over the other two. A hinged edge 108 fits inside the top of the container when the third flap 104 is folded into position. This third flap 104 also has an opening 109 therein which receives a hinge-edged extension 110 of the top 101 when the top is closed over the folded flaps. The extension 110 then extends inside the container and helps to secure the top in a closed position. By simply opening the integrally hinged top 101, the end of the towelettes through the aligned openings are exposed, and the towelettes can be easily pulled therethrough to remove them from the container.

The bag 300 for containing the roll 200 functions primarily to prevent the premoistened towelettes from drying out before they reach the consumer and before the consumer uses all of them. To fulfill this function, nearly any lightweight, flexible plastic bag will do. However, any other material which will inhibit vaporization of the moistening liquid in the roll may also be used for the bag and the same results will be obtained, for example, a polyethylene plastic bag. After the roll 200 is first inserted into the bag 300, the bag is closed in any manner which will effectively seal it shut, such as heat sealing the top edges 301 together. When it is time to withdraw the towelettes, the bag 300 is opened, and the top edges 301 are folded back.

The actual roll 200 of towelettes is a continuous web 201 which is perforated, as at 202, at intervals along the length thereof to form a plurality of sheets or towelettes 203 which can be separated from the remainder of the roll 200 by simply detaching along the perforations 202. The technique of forming such a roll 200 is not new, and it is possible for this invention to function when the end of the web 201 is withdrawn from either the inside of the roll or the outside. Furthermore, it is also possible to utilize either cored or coreless rolls of this web material, since the bulk or width of the roll is sufficient to support the roll in a vertical position while the towelettes are drawn therefrom. Also, the web material may be moistened with many different types of fluids depending on the determined usage of the towelettes, and therefore, this invention is not intended to be limited to any specific type of premoistened towelette.

Figure 3A:
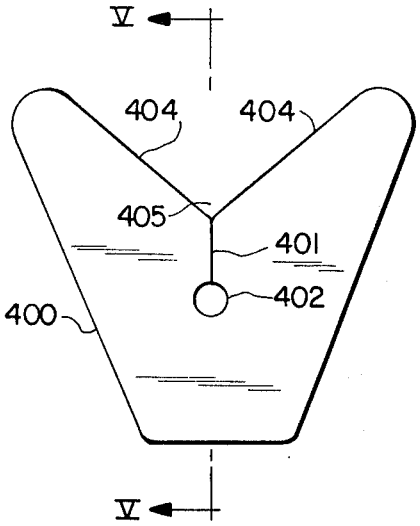
FIGS. 3*a*–3*c* and 4*a*–4*c* are plan views of various embodiments of dispensing plates according to this invention.
Figure 4A:
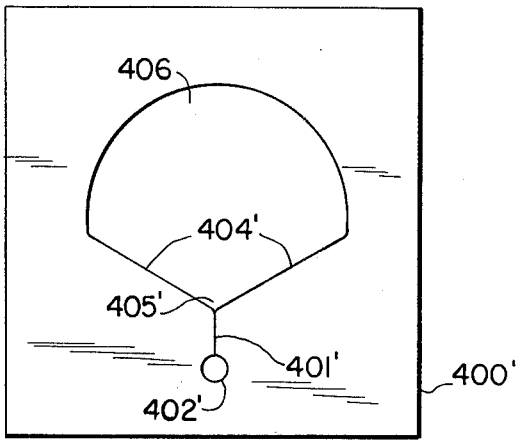

Two general embodiments for the dispensing plate are shown in FIGS. 3*a* and 4*a*. Each plate 400, 400' has a narrow slit 401, 401' which is directly connected to a hole or opening 402, 402'. The end of the roll 200 of towelettes is pulled through the narrow slit and then into the hole. The holes 402, 402' are, of course, sufficiently large enough to allow the towelettes 203 to be withdrawn therethrough from the inside of the bag 300. A significant feature of the openings 402, 402', however, is the fact that while the openings must be large enough to allow the towelettes 203 to be drawn therethrough, they must, at the sime time, provide enough friction to the web so that the towelettes will separate at their perforations 202 as they are pulled therethrough.

The principle distinction between the two plates of FIGS. 3*a* and 4*a* is in the construction of the opening space which leads into the slit 401 or 401'. In FIG. 3*a*, the plate 400 simply has sloping sides 404 leading into an entrance or outer end 405 of the slit 401. The sloping sides 404 facilitate guiding the end of the towelettes 203 into the slit 401. The variation in FIG. 4*a* shows a larger hole 406 in the plate 400' and which joins the outer end 405' of the slit 401', and the hole 406 has sloping sides 404' which converge directly into the slit 401'. To use this second embodiment of the plate 400', the towelette 203 is pulled through the hole 406 and then pulled between the sloping sides 404' into the slit 401' and toward the hole 402'. Then, in either embodiment, the towelette 203 is in the smaller hole 402, 402', and the plate therefore remains around the web at the top of the roll 200 with the end towelette extending through the smaller hole. The height of the bag 300 remains substantially constant, since the roll 200 is on end, and only the diameter of the roll decreases as the towelettes 203 are drawn therefrom, and not the height.

Figure 5:
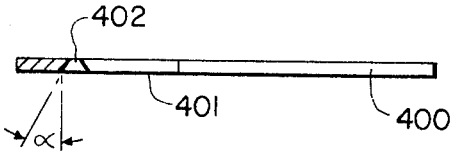
FIG. 5 is a sectional view of the dispensing plate of this invention, taken along line V—V of FIG. 3*a;*

The plate 400, it should be emphasized, may have almost any outer edge configuration, i.e., circular, square, polygonal, etc., as long as there is a slit therein with sloping sides leading into one end of the slit and with a hole at the other end of the slit. Also, even though the holes 402, 402' may be any opening through the plate 400 at the end of the slits 401, 401', as shown in FIGS. 3 and 4, it is preferred that the hole be circular. Furthermore, such circular hole may have a conical profile through the plate (see FIG. 5) at an angle $\alpha$ from 0° to 45° to facilitate withdrawing the towelette 203 therethrough. The plate itself should be made from a fairly rigid material, such as a light metal or rigid plastic, so that it will not deform greatly at the slit or hole when the towelette is pulled therethrough.

Figure 3B:
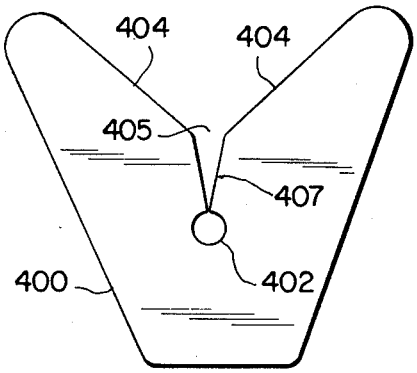
Figure 4B:
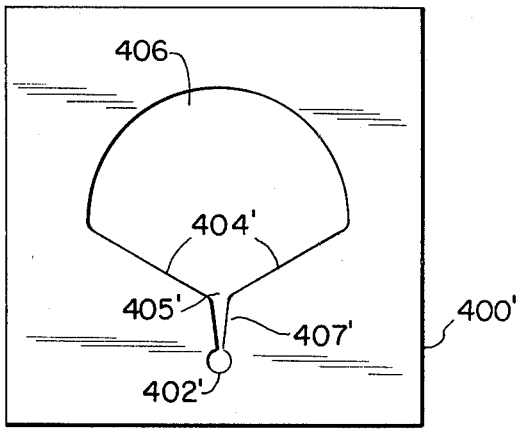
Figure 3C:
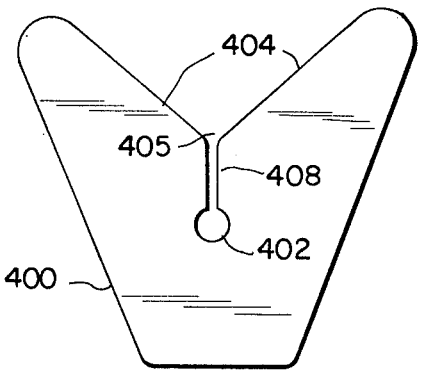
Figure 4C:
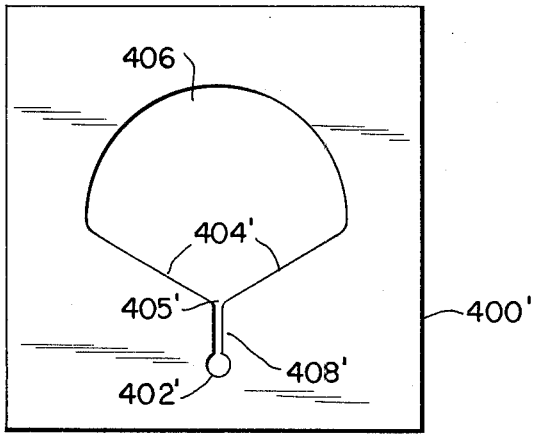

In FIGS. 3*a* and 4*a*, the slits 401 and 401' are of the type usually created by cutting or slitting the material comprising the plate. That is, even after the slit is created, both sides thereof will probably contact each other. On the other hand, FIGS. 3*b*, 3*c*, 4*b* and 4*c* show modifications of the slit configuration. FIGS. 3*b* and 4*b* show slits 407, 407' which are cut in a V-shape converging from the sloping sides 404, 404' toward the openings 402, 402'. FIGS. 3*c* and 4*c* show slits 408, 408' which consist of an opening with spaced parallel sides extending from the sloping sides 404, 404' toward the openings 402, 402'. In each of these various embodiments, the slit is designed to facilitate pulling the towelette from the open area at one end of the slit into the dispensing opening at the opposite end of the slit.

After the premoistened roll 200 of the towelettes is packaged in the bag 300, and the bag is appropriately sealed, such as by heat sealing, the bag then must be torn or cut open at the top by any suitable means by the consumer when it is time to withdraw the towelettes. This assures that the moisture remains in the roll until the towelettes are used. Once the bag 300 is open, the consumer may then easily affix the dispensing plate 400 or 400' around the end towelette 203 by pulling the end of the roll of towelettes out of the bag and sliding the towelette 203 along the sloping sides 404 or 404' of the plate 400 or 400' into the slit 401 or 401' and the opening 402 or 402'. The dispensing plate 400 or 400' is then allowed to rest on top of the roll 200 within the bag. As an alternative the dispensing plate may be received by the consumer in position around the end towelette of the roll already inside a sealed bag. This way, all that is necessary to prepare the package for use is to open the top of the bag, and dispensing of the towelettes through the plate can begin immediately.

One additional convenience of the dispensing plate 400 or 400' of this invention is the ease with which the towelettes 203 can be threaded therein, especially if the roll of towelettes should tear before the next towelette emerges through the dispensing hole 402 or 402'. The user need only remove the plate 400 or 400', pull up the next length of towelette 203 and slide it into the slit 401 or 401' and hole 402 or 402', as before.

Figure 6:
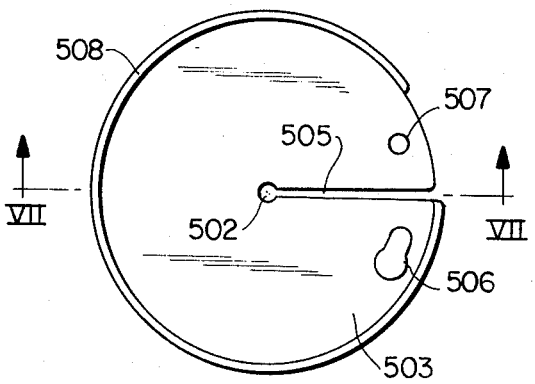
FIG. 6 is a plan view of a further embodiment of a dispensing plate according to this invention, shown in an unassembled condition.
Figure 7:
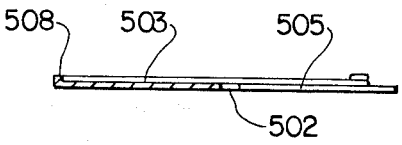
FIG. 7 is a sectional view taken along line VII—VII of FIG. 6.

With reference now to FIGS. 6 through 9 of the drawings, a further embodiment of the dispensing plate of the present invention will be described. In this embodiment, the dispensing plate 500 is produced as a flat disc 503 of a readily deformable material, for example a flexible plastic material. The disc 503 has formed centrally therein a dispensing hole 502. A radial slit 505 is formed in the disc 503, from the hole 502 therein to the periphery thereof. FIGS. 6 and 7 show the dispensing plate 500 in its initially produced and unassembled condition.

Figure 8:
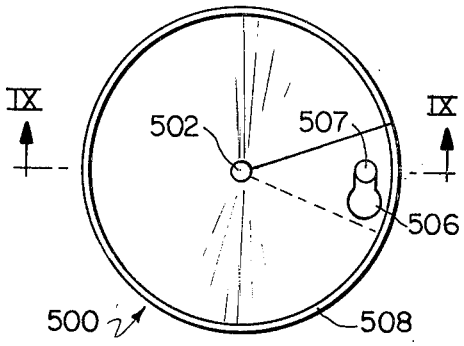
FIG. 8 is a plan view of the plate of FIG. 6, but shown in an assembled condition.
Figure 9:
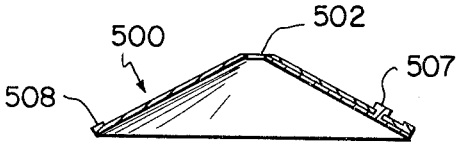
FIG. 9 is a sectional view taken along line IX—IX of FIG. 8.

Due to the provision of hole 502 and slit 505, the disc 503 may be deformed into a conical configuration, to thereby form an assembled dispensing plate 500, as shown in FIGS. 8 and 9 of the drawings.

The dispensing plate includes means for locking the disc in the assembled conical configuration thereof. In the illustrated embodiment, such locking means is in the form of a keyhole-shaped opening 506 formed in the disc adjacent one side of the slit 505, and a pin 507 having an enlarged head integral with the disc and extending upwardly therefrom adjacent the other side of the slit 505. Thus, it will be apparent that when the disc is deformed and assembled into its conical configuration, the enlarged head of pin 507 will be inserted into the larger end of opening 506 and then will slide into the smaller end of opening 506, whereby the enlarged head of the pin will retain the disc in the conical configuration. However, it is specifically to be understood that other locking arrangements may be readily employed to lock the flat disc 503 into the assembled conical configuration of the dispensing plate.

In further accordance with the present invention, the disc 503 may be provided with a peripheral reinforcing flange 508.

Figure 10:
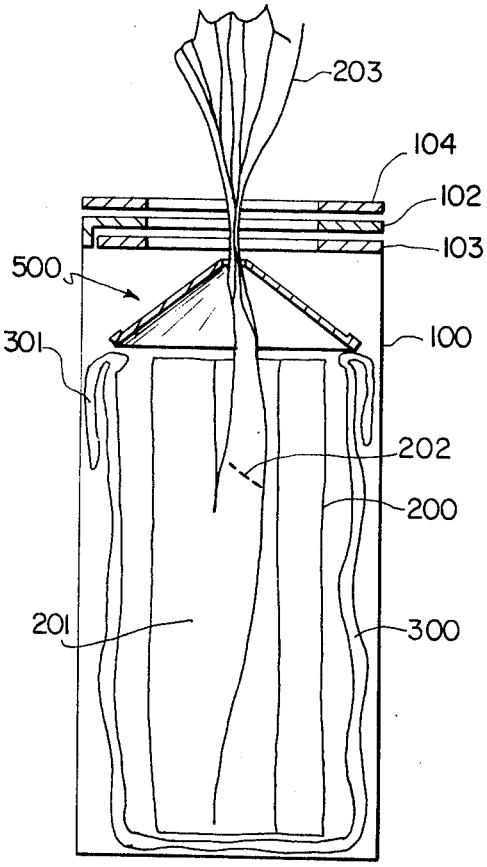
FIG. 10 is a schematic sectional view similar to FIG. 1, but illustrating a container according to the invention employing the plate of FIG. 8.

Reference will now be made to FIG. 10 of the drawings to illustrate a container in accordance with the present invention, employing the assembled dispensing plate 500 shown in FIGS. 8 and 9 of the drawings. Specifically, the assembly and manner of operation of the embodiment of the container illustrated in FIG. 10 is substantially the same as that illustrated and described above with reference to FIG. 1. However, in the embodiment of FIG. 10, the container is employed with a dispensing plate 500 as shown in FIGS. 8 and 9, such that a towelette 203 is extended through dispensing hole 502.

Figure 11:
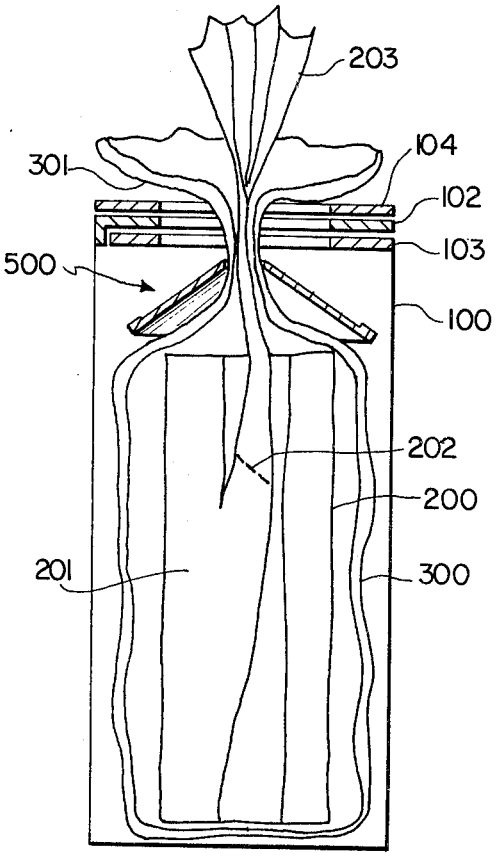
FIG. 11 is a schematic sectional view similar to FIG. 10, but illustrating a modification of the container-plate assembly thereof.

With reference now to FIG. 11, a modification of the container and plate arrangement of FIG. 10 will be described. This arrangement is similar in most respects to the arrangement of FIG. 10. However, in the embodiment of FIG. 11, both the towelette 203 and the top 301 of the bag 300 extend through the dispensing hole 502 of the dispensing plate 500. This arrangement will more effectively seal the roll of towelettes from the surrounding atmosphere and thus further prevent the loss of moisture from the roll.

The towelette 203 (FIG. 10) or the towelette 203 and top 301 of bag 300 (FIG. 11) may be easily introduced into the hole 502 by sliding through slit 505 prior to deformation and assembly of the disc 503 into the conical configuration thereof.

It is to be understood that in either of the embodiments of FIG. 10 or FIG. 11, the size of the hole 502 will be determined with respect to the particular towelette and bag employed such that the hole 502 will impart sufficient tension to the towelette being dispensed so that such towelette will tear away from the roll of towelettes along the perforations thereof, whereby the next succeeding towelette will be partially extended through the hole 502. In the embodiment of FIG. 11 however, the top 301 of the bag is gathered by the conical dispensing plate 500 around the end towelette 203, to thereby substantially close the top 301 of the bag around the towelette and substantially seal the remaining towelettes of the roll within the bag.

Since the package is designed to be made of lightweight materials, which are easily collapsible, disposal of the container after all of the towelettes are removed may be easily and efficiently accomplished.

It is recognized that further embodiments and modifications of the above described invention are possible within the scope of this invention, and therefore, it is not intended that the invention be limited to those embodiments specifically presented.

What I claim is:

1. A package for dispensing a continuous roll of premoistened perforated sheets, said package comprising:

a container for containing therein a continuous roll of premoistened perforated sheets;

bag means within said container and surrounding said roll for containing said roll therein and preventing said premoistened sheets from drying out; and dispensing plate means surrounding and directly contacting an end sheet of said roll for dispensing said end sheet therethrough, whereby said end sheet will tear from the next sheet on said roll at the perforations when said end sheet is drawn therethrough, said dispensing plate means comprising a conical-shaped plate having at the apex thereof a dispensing opening and an open bottom facing and positioned over said roll, said end sheet extending through said dispensing opening.

2. A package as claimed in claim 1, wherein said container comprises a liquid-impervious paper box having a plurality of sides, a bottom and a top hinged to at least one of said sides, and at least one flap hinged to one of said sides covering an upper portion of said box underneath said top, said flap having therein an opening through which said end sheet of said roll extends.

3. A package as claimed in claim 2, wherein said box is plastic-coated and has three hinged flaps with aligned openings therethrough underneath said top.

4. A package as claimed in claim 1, wherein said bag comprises a plastic bag surrounding said roll.

5. A package as claimed in claim 1, wherein said end sheet is directly contacted by an edge of said conical plate forming said dispensing opening.

6. A package as claimed in claim 1, wherein said conical plate is formed from a planar disc of flexible material, said disc having a central opening and a radial slit extending from said central opening to the periphery of said disc, whereby said disc is deformable about an axis through said central opening to overlap portions of said disc on opposite sides of said slit, to thereby form said disc into said conical plate, with said central opening forming said dispensing opening.

7. A package as claimed in claim 6, wherein said disc further includes a substantially annular peripheral reinforcing flange.

8. A package as claimed in claim 6, wherein said disc further includes means for locking said disc in the overlapped and deformed position thereof.

9. A package as claimed in claim 8, wherein said locking means comprises a pin with an enlarged head on one side of said slit, and a keyhole-shaped opening on the opposite side of said slit.

10. A package for dispensing a continuous roll of premoistened perforated sheets, said package comprising:

a container for containing therein a continuous roll of premoistened perforated sheets;

bag means within said container and surrounding said roll for containing said roll therein and preventing said premoistened sheets from drying out;

dispensing plate means surrounding an end sheet of said roll for dispensing said sheet therethrough, whereby said end sheet will tear from the next sheet on said roll at the perforations when said end sheet is drawn therethrough, said dispensing plate means comprising a conical-shaped plate having at the apex thereof a dispensing opening and an open bottom; and said conical-shaped plate being positioned with said open bottom facing and positioned over said roll, and with an end sheet of said roll and a top portion of said bag means extending through said dispensing opening, such that said conical-shaped plate surrounds and gathers said top portion of said bag means around said end sheet, and such that the remainder of said roll is substantially sealed within said bag means.

11. A package as claimed in claim 10, wherein said container comprises a liquid-impervious paper box having a plurality of sides, a bottom and a top hinged to at least one of said sides, and at least one flap hinged to one of said sides covering an upper portion of said box underneath said top, said flap having therein an opening through which said end sheet of said roll extends.

12. A package as claimed in claim 11, wherein said box is plastic-coated and has three hinged flaps with aligned openings therethrough underneath said top.

13. A package as claimed in claim 10, wherein said bag comprises a plastic bag surrounding said roll.

14. A package as claimed in claim 10, wherein said conical plate is formed from a planar disc of flexible material, said disc having a central opening and a radial slit extending from said central opening to the periphery of said disc, whereby said disc is deformable about an axis through said central opening to overlap portions of said disc on opposite sides of said slit, to thereby form said disc into said conical plate, with said central opening forming said dispensing opening.

15. A package as claimed in claim 14, wherein said disc further includes a substantially annular peripheral reinforcing flange.

16. A package as claimed in claim 14, wherein said disc further includes means for locking said disc in the overlapped and deformed position thereof.

17. A package as claimed in claim 16, wherein said locking means comprises a pin with an enlarged head on one side of said slit, and a keyhole-shaped opening on the opposite side of said slit.

18. A device for dispensing and separating a single perforated sheet from a continuous roll of perforated sheets, said device comprising:

a planar disc of flexible material;

said disc having therein a central opening and a radial slit extending from said central opening to the periphery of said disc; and said disc being deformable about an axis through said central opening, such that portions of said disc on opposite sides of said slit overlap, and such that said disc is deformed into a conical plate with said central opening forming a dispensing opening for dispensing therethrough sheets of a continuous roll of sheets.

19. A device as claimed in claim 18, wherein said disc further includes a substantially annular peripheral reinforcing flange.

20. A device as claimed in claim 18, wherein said disc further includes means for locking said disc in the deformed position thereof.

21. A device as claimed in claim 20, wherein said locking means comprises a pin with an enlarged head on one side of said slit, and a keyhole-shaped opening on the opposite side of said slit.

* * * * *